US007644502B2

(12) United States Patent
Arne

(10) Patent No.: US 7,644,502 B2
(45) Date of Patent: Jan. 12, 2010

(54) INDICATING APPARATUS AND METHOD

(76) Inventor: Bruce Albert Arne, 27 Oceanview Ave., Farmingville, NY (US) 11738

( * ) Notice: Subject to any disclaimer, the term of this patent is extended or adjusted under 35 U.S.C. 154(b) by 12 days.

(21) Appl. No.: 12/151,785

(22) Filed: May 8, 2008

(65) Prior Publication Data

US 2008/0276471 A1 Nov. 13, 2008

Related U.S. Application Data

(60) Provisional application No. 60/928,744, filed on May 10, 2007.

(51) Int. Cl.
*E04F 21/00* (2006.01)

(52) U.S. Cl. ..... 33/194; 33/464

(58) Field of Classification Search ..... 33/194, 33/197, 526, 527, 534, 464
See application file for complete search history.

(56) References Cited

U.S. PATENT DOCUMENTS

| | | | | | |
|---|---|---|---|---|---|
| 1,192,418 | A * | 7/1916 | Hallber | ..... | 33/194 |
| 2,473,639 | A * | 6/1949 | Erickson | ..... | 33/194 |
| 2,965,972 | A * | 12/1960 | Hunt | ..... | 33/197 |
| 3,484,945 | A * | 12/1969 | Clark | ..... | 33/464 |
| 3,635,396 | A * | 1/1972 | Palfi | ..... | 33/464 |
| 5,361,508 | A * | 11/1994 | Ruggiero | ..... | 33/464 |
| 5,737,990 | A * | 4/1998 | Freeland et al. | ..... | 33/641 |
| 6,049,990 | A * | 4/2000 | Holland | ..... | 33/464 |
| 6,134,797 | A * | 10/2000 | Boyce | ..... | 33/464 |
| 6,836,969 | B1 * | 1/2005 | Bates | ..... | 33/464 |
| 2003/0131486 | A1 * | 7/2003 | Wallace | ..... | 33/194 |
| 2007/0261250 | A1 * | 11/2007 | Bosch | ..... | 30/90.1 |
| 2007/0261256 | A1 | 11/2007 | Christensen et al. | | |
| 2008/0047152 | A1 * | 2/2008 | Wilding | ..... | 33/194 |
| 2009/0071020 | A1 * | 3/2009 | Kozina et al. | ..... | 33/194 |

* cited by examiner

*Primary Examiner*—G. Bradley Bennett
(74) *Attorney, Agent, or Firm*—Kenyon & Kenyon LLP

(57) ABSTRACT

An indicating apparatus includes a base arranged to contact a first surface of an opening in a wall and a second surface of the opening in the wall, the base being rotationally stable when contacting the first and second surfaces of the opening, and an indicating member coupled to the base, the indicating member having a first portion arranged to indicate a first line along the wall when the base contacts the surfaces of the opening, and a second portion arranged to indicate a second line along the wall when the base contacts the first and second surfaces of the opening, the first line being parallel to the first surface, the second line being parallel to the second surface.

14 Claims, 8 Drawing Sheets

3 Markings recorded

4 Molding cut based on outside distances measured from the marks made in step 1

$$\text{COSINE} = \frac{\text{SIDE ADJACENT}}{\text{HYPOTENUSE}}$$

$$\text{COS } 45° = \frac{1}{\text{HYP}} =$$

$$.7071067 = \frac{1}{\text{HYP}} =$$

$$(\text{HYP})\ .7071067 = \frac{1}{\text{HYP}}(\text{HYP}) =$$

$$(\text{HYP})\ .7071067 = 1 =$$

$$\frac{(\text{HYP})\ .7071067}{.7071067} = \frac{1}{.7071067}$$

$$\text{HYP} = \frac{1}{.7071067}$$

$$\text{HYP} = 1.414213$$

(SCIENTIFIC)
ON CALCULATOR :

45
COSINE
1/X

INDICATING APPARATUS AND METHOD

RELATED APPLICATIONS

The present application claims priority to U.S. Provisional Patent Application Ser. No. 60/928,744, filed on May 10, 2007, which is incorporated herein by reference in its entirety.

FIELD OF THE INVENTION

The present invention relates generally to an indicating apparatus and method.

BACKGROUND INFORMATION

Door and window moldings are typically measured and cut one piece at a time. Each piece of molding can take three or four trips to a miter saw to get the proper cut. Measurements for molding are typically taken from the inside surfaces of a structure, e.g., a door or window opening, which makes it difficult to obtain an accurate measurement. This is, in part, because a measurement device that is used to take the measurements has nothing to hold on to. For example, the inside of a door frame may be measured by running a tape measure along the inner surface of the doorframe. The measuring tape has nothing to grab on to which makes getting an accurate measurement difficult. Each window or door can take six or more trips to the miter saw. Additionally, each reveal, i.e., the distance between the molding and opening on the window or door may be different because of difficulty measuring and miter cutting and requires estimations. The width of the reveal also creates difficulty in determining the proper length of the molding as the molding for each corner will necessarily be longer than the opening.

SUMMARY

According to an example embodiment of the present invention, a tool includes: an elongated member having a distal indicating portion, the distal indicating portion having a first indicating edge lying along a first axis and a second indicating edge lying along a second axis, the first axis and the second axis defining an indicating line angle, the indicating line angle being bisected by a third axis, the first axis, the second axis, and the third axis being substantially coplanar; and a base coupled to the elongated member, the base including a first reference surface lying in a first plane that is parallel to the first indicating edge, a second reference surface lying in a second plane that is parallel to the second indicating edge, the first plane and the second plane intersecting at a line that is orthogonal to the third axis, a first lip extending from the first reference surface, the first lip defining a first reveal edge, the first reveal edge being parallel to the first indicating edge, a second lip extending from the second reference surface, the second lip defining a second reveal edge, a distance between the first reveal edge and the first reference plane being the same as a distance between the second reveal edge and the second reference plane, where the first indicating edge, the second indicating edge, the first reveal edge, the second reveal edge and the third axis are all substantially coplanar, and where the position of the elongated member in relation to the base is adjustable along the third axis.

The indicating line angle may be 90°.

The elongated member and the base may have graduated markings that correspond with each other to indicate an actual distance between the first indicating edge and the first reveal edge, depending on the position of the elongated member along the third axis with respect to the base.

According to an example embodiment of the present invention, a tool for indicating lines in relation to an opening in a wall includes: a base arranged to contact a first surface of the opening in the wall and a second surface of the opening in the wall, the base being rotationally stable when contacting the first and second surfaces of the opening; an indicating member coupled to the base, the indicating member having a first portion arranged to indicate a first line along the wall when the base contacts the surfaces of the opening, and a second portion arranged to indicate a second line along the wall when the base contacts the first and second surfaces of the opening, the first line being parallel to the first surface, the second line being parallel to the second surface.

The first surface and the second surface of the opening in the wall may correspond to a 90° angle.

The first portion and the second portion together may indicate an outer corner position for a molding.

At least one of the base and the indicating member may be arranged to indicate two reveal lines, the reveal lines disposed between the first indicating edge and the first surface and between the second indicating edge and the second surface, respectively.

The tool may be arranged to indicate a numeric value for an actual distance between the first indicating edge and the first reveal edge, depending on the position of the elongated member along the third axis with respect to the base.

The indicating member and the base may have graduated markings that correspond to indicate an actual distance between the first indicating edge and the first reveal edge, depending on the position of the elongated member with respect to the base.

At least one of the indicating member and the base may have an electronic measurement device to indicate an actual distance between the first indicating edge and the first reveal edge, the actual distance determined based on the position of the indicating member with respect to the base.

The distance between the reveal lines and the indicating edges may correspond to a molding width.

While the invention is not limited to any particular molding width, an exemplary molding width may be about 2 inches to 6½ inches. A tool of the invention may be adjustable to accommodate any molding width or may be fixed for a specific molding width.

According to an example embodiment of the present invention, a method of determining molding length using a tool, the tool arranged to be stably received by an inside corner of an opening in the wall, includes: indicating an outside corner position by inserting the tool into an inside corner of the opening in the wall, the outside corner position corresponding to where outer edges of the molding would need to meet in order to provide a predetermined reveal distance; measuring a distance to the indicated outside corner position; and cutting the molding by performing an outside miter cut based on the measurement of the distance to the indicated outside corner position.

According to an example embodiment of the present invention, an indicating apparatus, e.g., a casement ruler is set to the width of the molding, the length of which is to be determined. As shown in the Figures, the width of the molding corresponds to graduation markings placed on the apparatus. The distance between the graduation markings, which correspond to the different widths of the moldings, may be calculated as shown in FIG. 8, e.g., a 1" width piece of molding may correspond to a distance of 1.414213" between graduation markings. The indicating apparatus is adjusted to provide for a specific width of molding. The indicating apparatus is then placed on the door or window to be measured and overall marks and reveal marks are made, see, e.g., FIG. 7. Measurements are taken to the marks (or to an outside surface of the indicating apparatus itself). These measurements provide for outside dimensions of moldings to be cut. The moldings are then cut based on these outside dimensions. For example, a miter saw may be set to make a 45 degree cut. The 45 degree cut will be made based on the outside dimension of the molding that has been measured, i.e., the cut will be made from the outside of the miter.

According to some example embodiments of the present invention, an indicating apparatus includes an elongated member with graduation markings that correspond to different widths of molding and an angled surface. The indicating apparatus may also include a block configured to traverse the elongated member. The block may have surfaces configured to mate with the inside corner of a door or window. The block may also have additional surfaces, e.g., that form a lip, that indicate the position of a reveal when the block is mated with the inside corner of the door or window. The position of the angled surfaces of the elongated member, shown as an arrow type arrangement in the Figures, extend to indicate the location of an outside corner of the molding. Adjustments may be made for the positioning of the block to account for reveals. The angled surfaces of the elongated member may be essentially parallel to the surfaces of the block that mate with the inside corner of the door or window. The elongated member may be slotted and the adjustable block may be configured to traverse the slot. The block may include a securing mechanism, such as set screws, that secure the block in different positions along the elongated member. The block may include markings that align with graduation markings on the elongated member.

According to an example embodiment of the present invention the method and apparatus described herein may be used for molding ranging between approximately 2" in width and approximately 6½" in width. The different width dimensions may be included on the elongated member according to corresponding graduation marking.

According to an example embodiment of the present invention the apparatus described herein may be made of a metal, a plastic, a composite material or any other suitable material.

According to an example embodiment of the present invention a method and apparatus, as described above is provided in a throw away plastic version that is not adjustable and is configured for moldings with a specific width (e.g., 2¼", 2½", 3", 3½", 4", etc.).

According to an example embodiment of the present invention a method and apparatus as described herein incorporates the features of a digital slide ruler.

The aforementioned method and device may be particularly suitable to provide for simple measurements, easy outside miter cutting, accurate cutting and time savings in that a single trip to the miter saw may be made. Using the aforementioned method and device, door and window moldings for an entire house can be completed by writing down all measurements and going to the miter saw one time. The method and device provide for accurate cuts and reveals.

DETAILED DESCRIPTION

Figure 1:
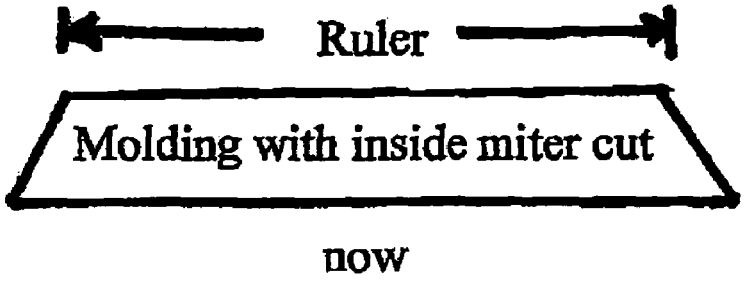
FIG. 1 shows a miter cut based on inner dimensioning.
Figure 2:
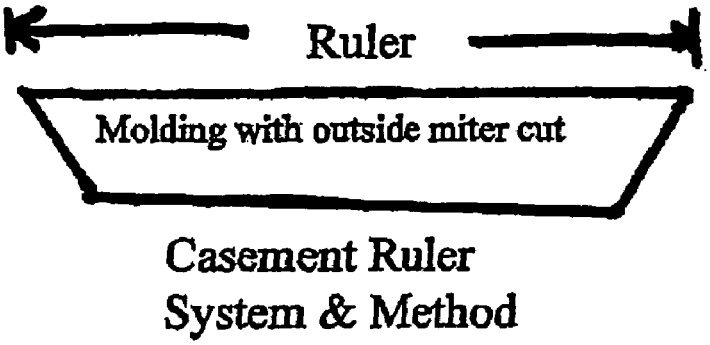
FIG. 2 shows a miter cut based on outer dimensioning.

FIGS. 1 and 2 show miter cuts based on inner and outer dimensioning, respectively.

Figure 3:
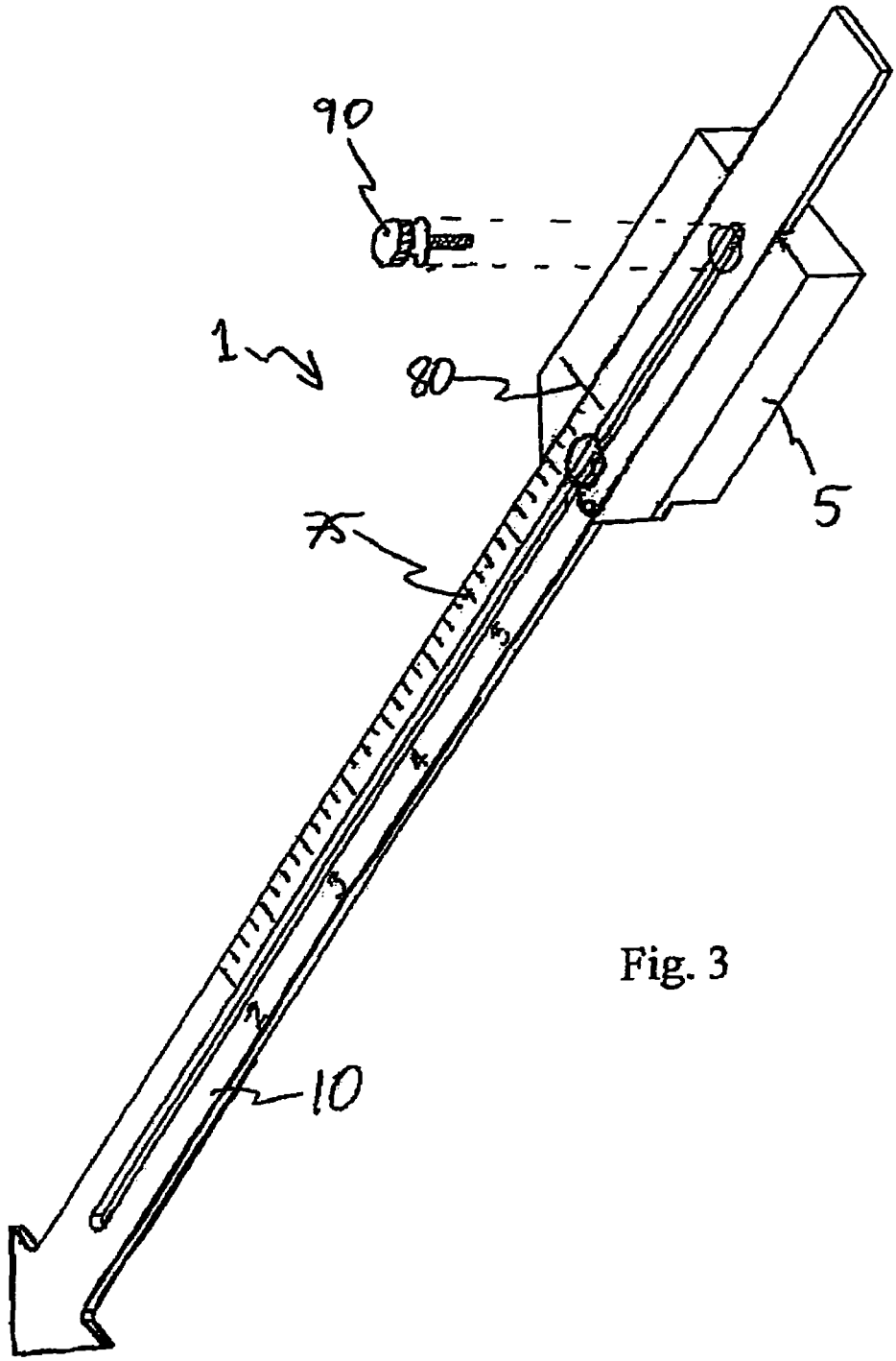
FIG. 3 shows an indicating device according to an example embodiment of the present invention.
Figure 4:
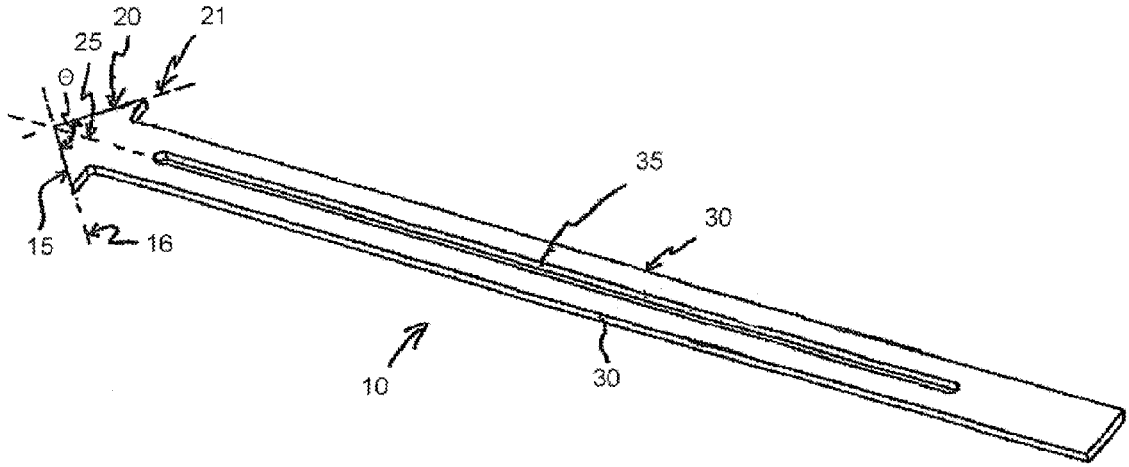
FIG. 4 shows an elongated member of an indicating apparatus according to an example embodiment of the present invention.

FIG. 3 shows an indicating apparatus or device 1 having a block or base 5 coupled to an elongated indicating member 10. Referring to FIG. 4, the indicating member 10 has, at a distal, arrow-shaped indicating portion, a first indicating edge 15 lying substantially along a first axis 16 and a second indicating edge 20 lying substantially along a second axis 21. In this regard, the first indicating edge 15 and the second indicating edge 20 may vary slightly from the first axis 16 and the second axis 21, respectively, so long as the edges provide a relatively linear indication of a line along the axes when the indicating member is placed against a flat surface, e.g., a wall. For example, the edges may fluctuate, when viewed from the side, within a range of about the thickness of the indicating portion. The edge should, however, be disposed closely enough to the surface such that a consistent line may be marked by guiding, e.g., a pencil along and against the edge. Thus, the edge need not necessarily fall exactly flush with the surface, e.g., the wall. The first axis 16 and the second axis 21 intersect to define an indicating line angle Θ. The indicating line angle Θ thereby defines an angle, e.g., 90 degrees, between the first indicating edge 15 and the second indicating edge 20. As shown in FIG. 4, the upwardly directed face of the indicating member 10 corresponds to the face that is directed downwardly toward the base 5 when the indicating member 10 is connected to the base. A third axis 25 is coplanar with the first axis 16 and the second axis 21 such that the third axis 25 bisects the angle Θ between the first axis and the second axis. As such, the angle between the third axis 25 and the first axis 16 is one half of the angle Θ, as is the angle between the third axis 25 and the second axis 21. As shown, the indicating member 10 extends lengthwise along the third axis 25. The extended portion of the indicating member 10 has a pair of side surfaces 30, each of which extends in parallel to the third axis 30. The indicating member 10 also has an elongated slot 35 that extends along the third axis 25. Although the device 1 is arranged to be inserted into a corner having an angle Θ equal to 90 degrees, it should be appreciated, that according to other examples, the angle may different, e.g., 135 degrees, or adjustable between different angles, e.g., adjustable among angles between 90 degrees and 180 degrees.

Figure 5A:
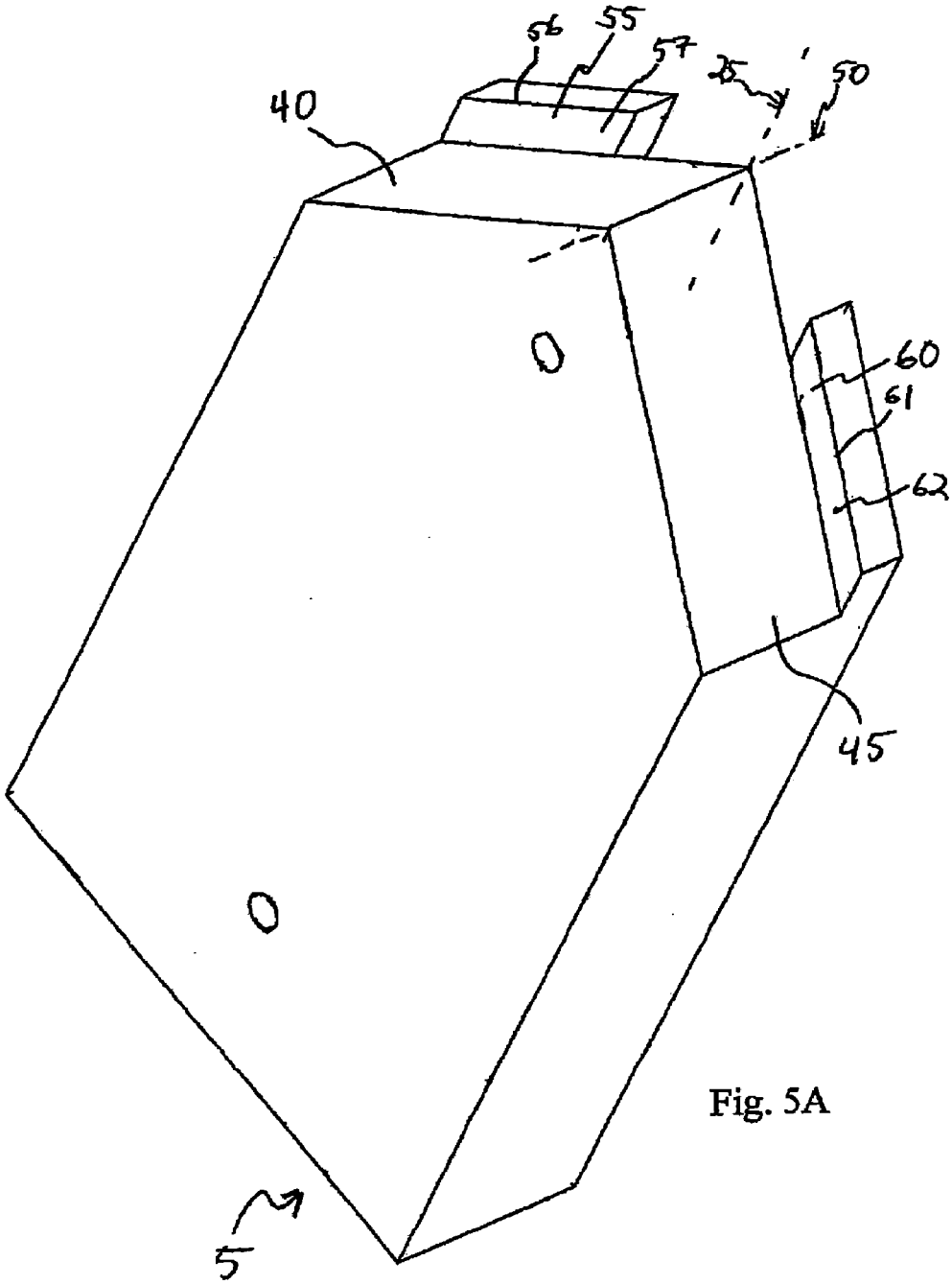
FIGS. 5A and 5B show a block of an indicating apparatus according to an example embodiment of the present invention.
Figure 5B:
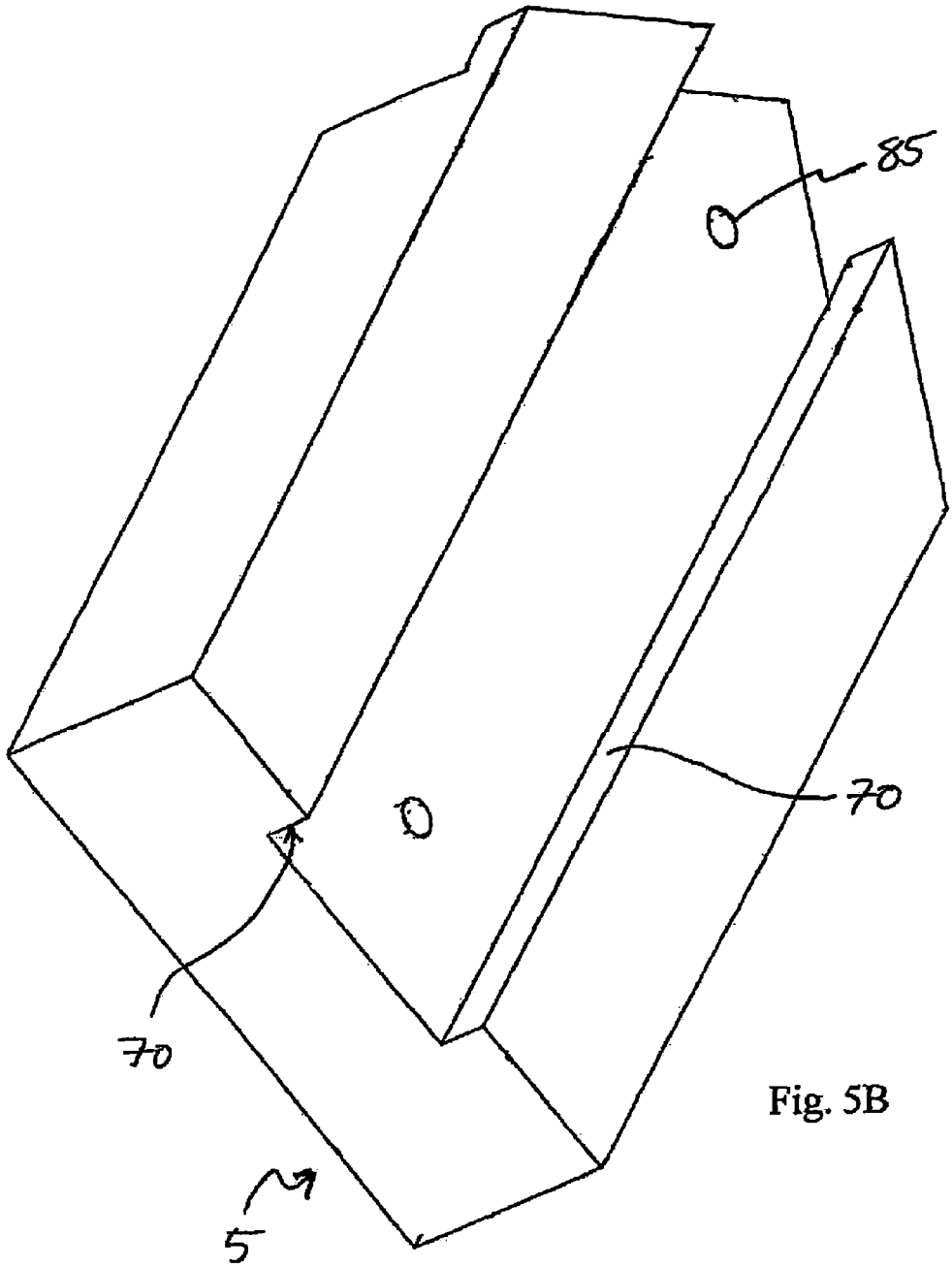

FIGS. 5A and 5B show a block or base 5. The base has a first reference surface 40 lying in a first plane that is parallel to the first indicating edge 15 of the indicating member 10, and a second reference surface 45 lying in a second plane that is parallel to the second indicating edge 20 of the indicating member 10, when the indicating member 10 is coupled to the base 5, as shown, e.g., in FIG. 3. However, it should be appreciated that, according to other examples, the reference surfaces may be non planar, e.g., curved surfaces, or a plurality of cylindrical pegs. The first plane and the second plane intersect at an intersection line or axis 50 that intersects and is orthogonal to the third axis 25 of the indicating member when the indicating member 10 is coupled to the base 5. Thus, the angle between the first reference surface 40 and the second reference surface 45 is the same as the indicating line angle Θ. The base 5 has a first lip 55 extending outwardly away from the first surface 40 and a second lip 60 extending outwardly away from the second surface 45. The first lip 55 defines a first reveal edge 56, which is parallel to the first indicating edge 15 when the indicating member 10 is coupled to the base 5. The second lip 60 defines a second reveal edge 61, which is parallel to the second indicating edge 20 when the indicating member 10 is coupled to the base 5. The first indicating edge 15, the second indicating edge 20, the first reveal edge 56, the second reveal edge 61 and the third axis 25 are all substantially coplanar. That is, the first indicating edge 15, the second indicating edge 20, the first reveal edge 56, and the second reveal edge 61 are arranged such that when the device 1 is disposed against a flat surface, e.g., a wall, each of the first indicating edge 15, the second indicating edge 20, the first reveal edge 56, and the second reveal edge 61 are sufficiently close to the flat surface such that a consistent line may be marked by guiding, e.g., a pencil along and against each of the first indicating edge 15, the second indicating edge 20, the first reveal edge 56, and the second reveal edge 61. The reveal edges 56, 61 are arranged at the same set distance from the reference surfaces 40, 45. In this manner, the reveal edges 56, 61 indicate a position of a reveal edge when the device is set for a particular width of molding. However, it should be appreciated that, according to other examples, the lips may be arranged such that the distances of the reveal edges from the reference surfaces may be different for each reveal edge and/or the distances from the reveal edges to the reference surfaces may be adjustable.

The first reference surface 40 and the second reference surface 45 are arranged to fit into an angled corner such that the device 1 rests in a stable manner in the corner. By, e.g., maintaining a slight force along the third axis, i.e., directly into the direction of the interior angle of the corner, the base tends toward a stable position, such that the base provides resistance from rotation from the stable position. By, i.e., pressing the device 1 slightly downwardly, i.e., in a direction perpendicular to the flat surface of the structure, e.g., the flat portion of a wall adjacent to an opening in the wall, the device comes to rest as a result of a hard, or positive, stop between the structure, e.g., the wall, and at least one of (a) the bottom surface of the indicating member 10 and (b) the bottom surfaces 57, 62 of the first and second lips 55, 60. However, it should be appreciated that, according to other example embodiments, the base and/or the indicating member may have additional features that form the positive stop. As a result of the positive stop and the interface between the reference surfaces 40, 45 of the base 5 and the geometry of the interior corner of the opening, the device 1 is easily placed into an opening so as to come to a stable resting position and angle. In this manner, the indicating member 10 may be maintained at a set position in relation to the interior corner of the structure, thereby allowing accurate measuring and/or marking of the lines indicated on the surface of the structure, e.g., the wall, by the indicating member 10.

Referring to FIG. 5B, the base 5 has inner walls 70 which are arranged prevent rotation of the indicating member 10 as a result of the communication of the inner walls 70 of the base 5 and the side surfaces 30 of the indicating member 10 when the indicating member 10 is coupled to the base 5, as shown, e.g., in FIG. 3. However, the inner walls 70 allow the indicating member 10 to slide therebetween along the third axis 25. This ability of the indicating member 10 to slide along the third axis 25 allows the position of the first and second indicating edges 15, 20 to be adjusted with relation to the reference surfaces 40, 45, and therefore in relation to the inner corner of the opening. As such, a corner between a first line and a second line may be indicated by the indicating edges where an outer corner of a mitered molding joint will fall. The distance between the first indicating edge 15 and the first reference surface 40 and the distance between the second indicating edge 20 and the second reference surface 45 are the same, regardless of the angle Θ of the corner. Because the third axis 25 bisects the angle Θ, extension or retraction of the indicating member 10 will not affect this relationship, i.e., the two distances are adjustable but will remain the same as one another. In this manner, the device 1 is easily adjustable to accommodate various widths of molding. To simplify this process, the top surface of the indicating member has a series of gradations 75 that align with a mark 5 to indicate a perpendicular distance between the lines indicated by the indicating edges 15, 20 and the respective lines indicated by the reveal edges 56, 61. Thus, the device may be arranged for a particular width of molding by sliding the indication member along the axis 25 until the mark 5 aligns with the gradation 75 that indicates the particular width. As such, the reveal edges will indicate where the inner edges of the molding pieces will fall and the indicating edges will indicate where the outer edges of the molding and/or a corner of a mitered joint between the pieces of molding will fall. Although the device 1 uses a system of graduated markings, it should be appreciated that, according to other examples, other systems may be used, e.g., a dial or a digital system.

Because the inner walls 70 of the base 5 do not prevent the indication member 10 from sliding along the third axis 25, the device 1 has a mechanism arranged to releasably hold the indication member in place once the desired adjustment is made. The base 5 has two internally threaded bores or holes 85 arranged to receive two thumbscrews 90 (only one of which is shown, referring to FIG. 3) that have externally threaded shafts that extend through the elongated slot 35 so as to be received in threaded communication with the threaded holes 85. In this regard, the portion of each thumbscrew 90 that extends outside the elongated slot 35 presses downwardly against the top surface of the indicating member 10, resulting in a substantial frictional force to hold the indicating member 10 in place. However, it should be appreciated that, according to other examples, the indicated member 10 may be held in place in a different manner, e.g., a series of detents.

Although the device shown is adjustable to accommodate molding widths of between 2 inches and 6.5 inches with a reveal distance of approximately a quarter of an inch, it should be appreciated that, according to other examples, the device may be adjustable to different lengths and indicate different reveal distances.

It should be further appreciated that, according to other examples, the device may be formed from a single piece, e.g., where the molding width is predetermined.

Figure 6:
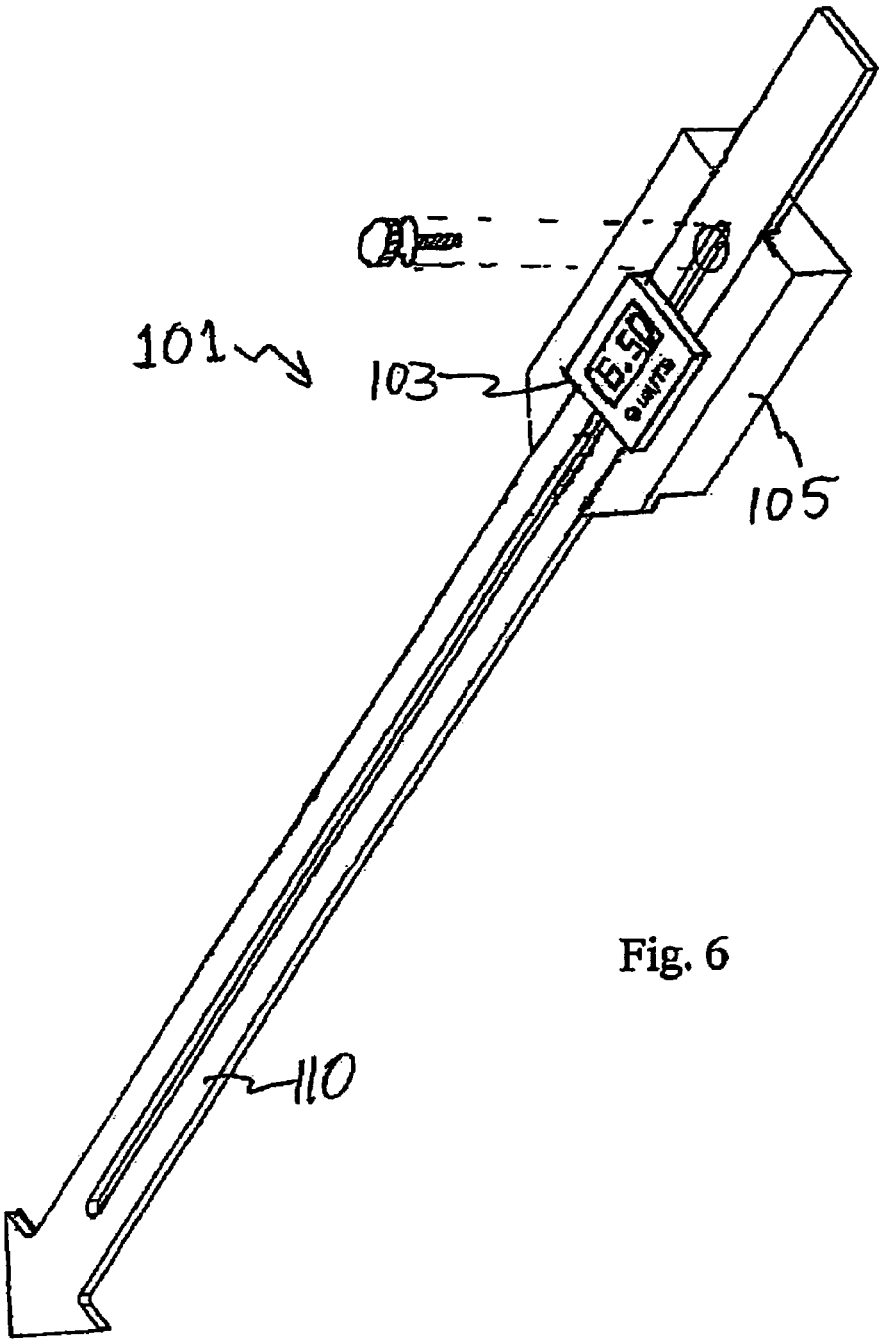
FIG. 6 shows an indicating device according to an example embodiment of the present invention.

FIG. 6 shows an indicating apparatus or device 101 having many features in common with the device 1. Instead of graduated markings, however, the device 101 has a digital measurement device 103 arranged to output a value of a perpendicular distance between the lines indicated by the indicating edges and the respective lines indicated by the reveal edges, based on the position of the indicating member 110 along its longitudinal axis with respect to the base or block 105.

Figure 7:
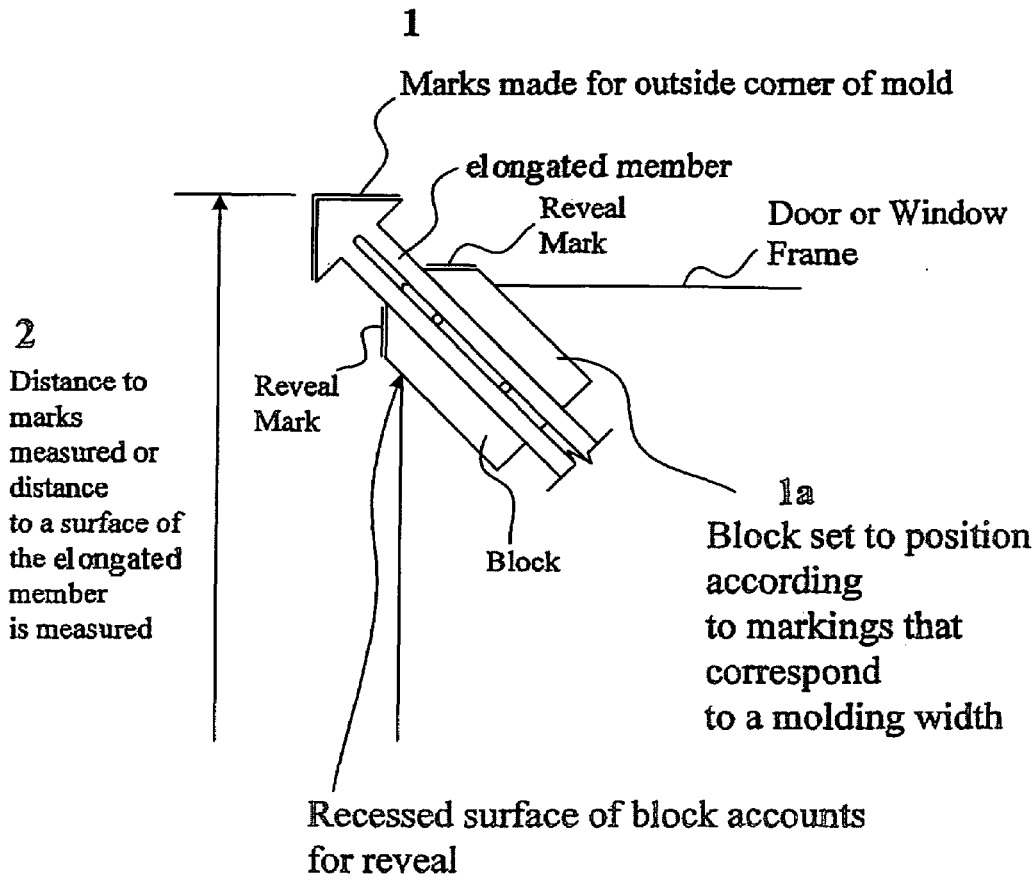
FIG. 7 shows a method and an apparatus according to an example embodiment of the present invention positioned in an inside corner of a door or window frame.

FIG. 7 shows a method of determining a length to which molding is cut using an indicating apparatus or device having many features analogous to the device 1 described above, where the indicating apparatus is arranged to be stably received by an inside corner of an opening in the wall. The method includes indicating an outside corner position by inserting the tool into an inside corner of the opening in the wall, the outside corner position corresponding to where outer edges of the molding would need to meet in order to provide a predetermined reveal distance, measuring a distance to the indicated outside corner position, and cutting the molding by performing an outside miter cut based on the measurement of the distance to the indicated outside corner position. The method may also include adjusting the indicating apparatus to mark the outside corner based on a particular width of molding, marking the wall according to the indication of the outside corner position, and/or marking a reveal along two edges. The distance to the indicated outside corner may be measured in relation to, e.g., a surface against which the respective piece of molding to abut. Although the corner mark shown in FIG. 7 is two connecting lines, it should be appreciated that a single mark, e.g., a point or dot, may be made, which indicates the corner point, i.e., an approximate intersection point of two lines co-linear with the outside edge position of the molding, each of the lines parallel and equidistant from the inner surfaces of the opening.

Figure 8:
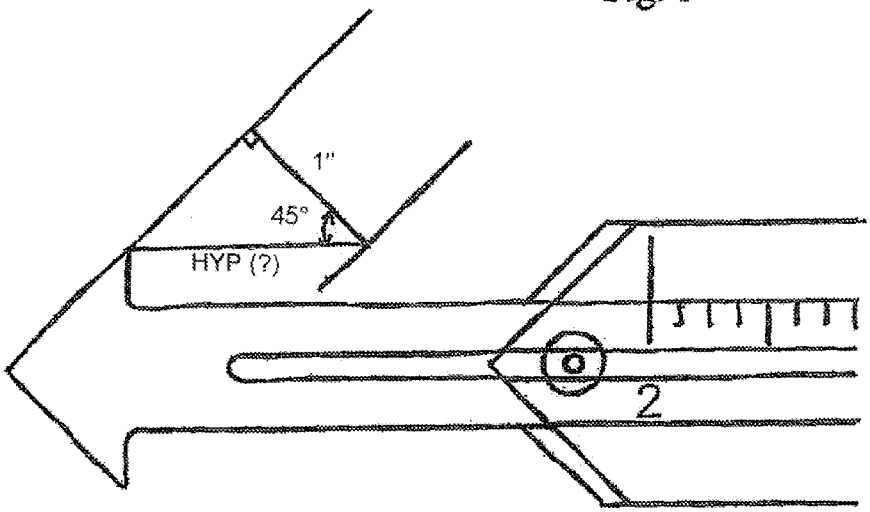
FIG. 8 shows a calculation of a distance between graduation markings.

FIG. 8 shows a calculation of a distance between graduation markings.

Although the present invention has been described with reference to particular examples and exemplary embodiments, it should be understood that the foregoing description is in no manner limiting. Moreover, the features described herein may be used in any combination.

What is claimed is:

1. A tool, comprising:

an elongated member having a distal indicating portion, the distal indicating portion having a first indicating edge lying along a first axis and a second indicating edge lying along a second axis, the first axis and the second axis defining an indicating line angle, the indicating line angle being bisected by a third axis, the first axis, the second axis, and the third axis being substantially coplanar; and a base coupled to the elongated member, the base having a first reference surface lying in a first plane that is parallel to the first indicating edge, a second reference surface lying in a second plane that is parallel to the second indicating edge, the first plane and the second plane intersecting at a line that is orthogonal to the third axis, a first lip extending from the first reference surface, the first lip defining a first reveal edge, the first reveal edge being parallel to the first indicating edge, and a second lip extending from the second reference surface, the second lip defining a second reveal edge, a distance between the first reveal edge and the first reference plane being the same as a distance between the second reveal edge and the second reference plane, wherein the first indicating edge, the second indicating edge, the first reveal edge, the second reveal edge and the third axis are all substantially coplanar, wherein the position of the elongated member in relation to the base is adjustable along the third axis.

2. The tool according to claim 1, wherein the indicating line angle is 90°.

3. The tool according to claim 1, wherein the elongated member and the base have graduated markings that correspond to indicate an actual distance between the first indicating edge and the first reveal edge, depending on the position of the elongated member along the third axis with respect to the base.

4. A tool for indicating lines in relation to an opening in a wall, the tool comprising:

a base configured to contact a first surface of the opening in the wall and a second surface of the opening in the wall, the base being rotationally stable when contacting the first and second surfaces of the opening;

an indicating member coupled to the base, the indicating member having a first portion configured to indicate a first line along the wall when the base contacts the surfaces of the opening, and a second portion configured to indicate a second line along the wall when the base contacts the first and second surfaces of the opening, the first line being parallel to the first surface, the second line being parallel to the second surface.

5. The tool of claim 4, wherein the first surface and the second surface of the opening in the wall correspond to a 90° angle.

6. The tool of claim 4, wherein the first portion and the second portion together indicate an outer corner position.

7. The tool of claim 4, wherein at least one of the base and the indicating member is configured to indicate two reveal lines, the reveal lines disposed between the first indicating edge and the first surface and between the second indicating edge and the second surface, respectively.

8. The tool of claim 7, wherein the device is arranged to indicate a numeric value for an actual distance between the first indicating edge and the first reveal edge, depending on the position of the elongated member along the third axis with respect to the base.

9. The tool of claim 8, wherein the indicating member and the base have graduated markings that correspond to indicate an actual distance between the first indicating edge and the first reveal edge, depending on the position of the elongated member with respect to the base.

10. The tool of claim 8, wherein at least one of the indicating member and the base has an electronic measurement device to indicate an actual distance between the first indicating edge and the first reveal edge, depending on the position of the indicating member with respect to the base.

11. The tool of claim 7, wherein the distance between the reveal lines and the indicating edges corresponds to a molding width.

12. The tool of claim 11, wherein the molding width is at least 2 inches.

13. The tool of claim 12, wherein the device is adjustable to accommodate a molding width of at least 5 inches.

14. A method of determining a length of molding using a tool, the tool configured to be stably received by an inside corner of an opening in the wall, the method comprising:

indicating an outside corner position by inserting the tool into an inside corner of the opening in the wall, the outside corner position corresponding to where outer edges of the molding would need to meet in order to provide a predetermined reveal distance;

measuring a distance to the indicated outside corner position; and cutting the molding by performing an outside miter cut based on the measurement of the distance to the indicated outside corner position.

* * * * *